US007200901B2

(12) United States Patent
Pitts et al.

(10) Patent No.: US 7,200,901 B2
(45) Date of Patent: Apr. 10, 2007

(54) ZIPPER SECURING DEVICES

(75) Inventors: Christopher Brian Pitts, Long Beach, CA (US); Casey D. Fleming, Dana Point, CA (US)

(73) Assignee: Quiksilver, Inc., Huntington Beach, CA (US)

( * ) Notice: Subject to any disclaimer, the term of this patent is extended or adjusted under 35 U.S.C. 154(b) by 0 days.

(21) Appl. No.: 10/849,278

(22) Filed: May 18, 2004

(65) Prior Publication Data

US 2005/0257351 A1 Nov. 24, 2005

(51) Int. Cl.
*A44B 19/36* (2006.01)
*E05B 67/38* (2006.01)

(52) U.S. Cl. ..... 24/436

(58) Field of Classification Search ..... 24/415, 24/387, 418, 436, 386, 388; 292/307 R, 292/317–319; 70/68, 67, 23
See application file for complete search history.

(56) References Cited

U.S. PATENT DOCUMENTS 1,680,652 A * 8/1928 Walinsky ..... 70/68
2,223,347 A * 12/1940 Hermine ..... 24/387
2,297,657 A * 9/1942 L'Hollier ..... 36/50.1
2,531,805 A * 11/1950 Clark ..... 294/3.6
2,575,187 A * 11/1951 Schaye ..... 24/418
2,826,797 A * 3/1958 Reeves et al. ..... 24/387
2,845,670 A * 8/1958 Brown et al. ..... 24/16 R
3,138,377 A * 6/1964 Stewart ..... 482/82
3,141,536 A * 7/1964 Fulton ..... 190/119
3,448,463 A * 6/1969 Milone ..... 2/234
3,852,851 A * 12/1974 Higuchci et al. ..... 24/387
3,911,537 A * 10/1975 Mazur ..... 24/668
4,081,882 A * 4/1978 Toepelt et al. ..... 24/386
4,815,176 A * 3/1989 Yoshida ..... 24/387
4,928,363 A * 5/1990 Easton ..... 24/390
5,008,985 A * 4/1991 Thompson ..... 24/370
5,063,760 A * 11/1991 Horita et al. ..... 70/23
5,081,855 A * 1/1992 Terada et al. ..... 70/68
5,101,538 A * 4/1992 Dieter ..... 24/429
5,163,191 A * 11/1992 Chan ..... 5/98.1
5,347,692 A * 9/1994 Ebata ..... 24/429
5,417,304 A * 5/1995 Kurtgis ..... 182/150
5,423,164 A * 6/1995 Schneider ..... 54/44.1
5,568,951 A * 10/1996 Morgan ..... 292/307 A
5,586,368 A * 12/1996 Nelson ..... 24/390
5,690,444 A * 11/1997 Yuuki et al. ..... 403/268
6,161,959 A * 12/2000 Abraham ..... 383/97
6,237,252 B1 * 5/2001 Cook ..... 36/50.1
6,737,974 B2 * 5/2004 Dickinson ..... 340/572.8
2003/0145636 A1 * 8/2003 Nykoluk ..... 70/68

* cited by examiner

*Primary Examiner*—Robert J. Sandy
*Assistant Examiner*—André L. Jackson
(74) *Attorney, Agent, or Firm*—Snell & Wilmer LLP

(57) ABSTRACT

Zipper securing devices for keeping zippers in a securely closed but unlocked condition that provide for easy unfastening and re-fastening of the zipper securing device. In one embodiment, the zipper securing device comprises an elastic loop assembly and post. In a second embodiment, the zipper securing device comprises two zipper pulls which snap together. In a third embodiment, the zipper securing device comprises a hook assembly and zipper pull assembly. In a fourth embodiment, the zipper securing device comprises an elastic loop assembly and zipper slider assembly.

8 Claims, 2 Drawing Sheets

Fig. 3a
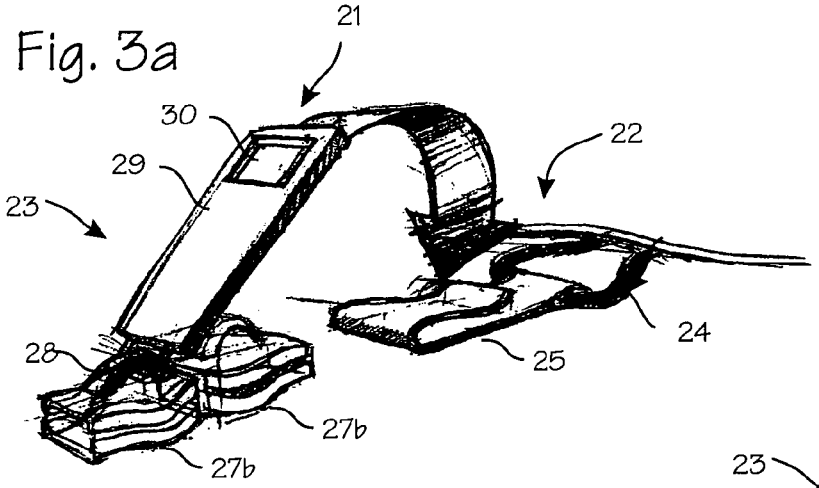
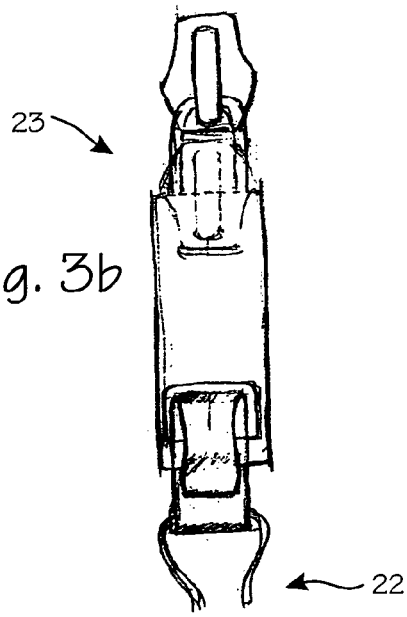
Fig. 3b
Fig. 4
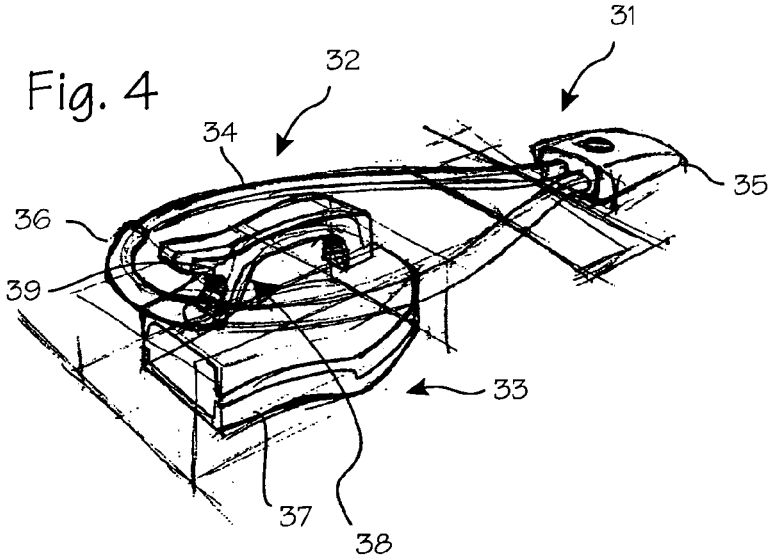

ZIPPER SECURING DEVICES

FIELD OF THE INVENTIONS

The inventions described below relate to the field of zippers, and more particularly to zipper securing devices.

BACKGROUND OF THE INVENTIONS

Airport security procedures today forbid the use of locking devices to lock suitcases. However, securing devices are still needed to keep suitcases from popping open on baggage conveyer belts or elsewhere in the baggage handling system. A releasable zipper securing device is needed such that security personnel can easily unfasten the zipper securing device, un-zip the zipper, re-zip the zipper, and refasten the zipper securing device.

SUMMARY

The zipper securing devices described below keep zippers in a securely closed but unlocked condition and provide for easy un-fastening and re-fastening of the zipper securing device. In one embodiment, the zipper securing device comprises an elastic loop assembly and post. In a second embodiment, the zipper securing device comprises two zipper pulls which snap together. In a third embodiment, the zipper securing device comprises a hook assembly and zipper pull assembly. In a fourth embodiment, the zipper securing device comprises an elastic loop assembly and zipper slider assembly.

The zipper securing devices described herein are described with respect to zipper assemblies in suitcases or zippered luggage. However, these devices may be used for any zipper application, such as clothing, children's shoes, backpacks, etc.

BRIEF DESCRIPTION OF THE DRAWINGS

FIGS. 3*a* and 3*b* show a zipper securing device comprised of a hook assembly and a zipper pull assembly.

FIG. 4 shows a zipper securing device comprised of an elastic loop assembly and zipper slider assembly.

DETAILED DESCRIPTION OF THE INVENTIONS

Figure 1A:
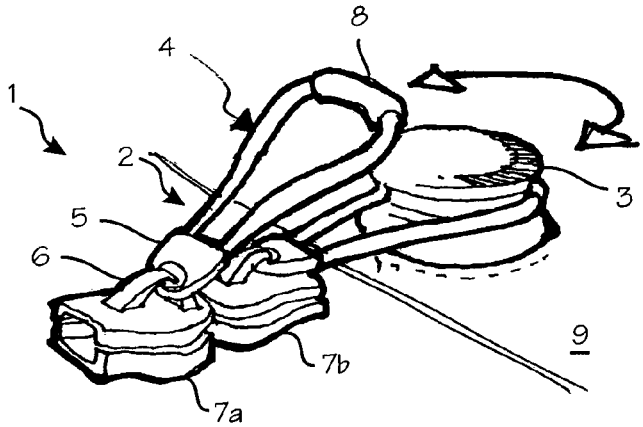
FIGS. 1*a* and 1*b* show a zipper securing device comprised of an elastic loop assembly and post.
Figure 1B:
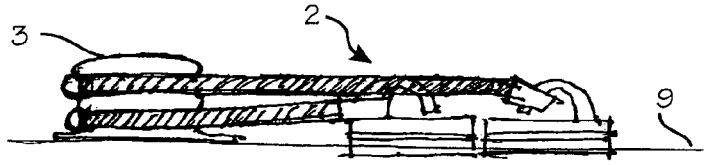

FIG. 1*a* shows a zipper securing device 1 comprised of an elastic loop assembly 2 and post 3. The elastic loop assembly further comprises elastic cording 4 wherein the proximal ends of the elastic cording are fixedly attached to a base 5. The base is attached to the upstanding tang or loop 6 of the zipper slider 7. The elastic loop assembly 2 may also be assembled such that the elastic cording is fished through the upstanding tang or loop wherein the proximal ends of the elastic cording are fixedly attached to the base. A flexible plastic sleeve 8 encompasses the elastic cording at the end of the elastic loop assembly that comes into contact with the post 3. The plastic sleeve acts to prevent fraying or damage to the elastic cording. FIG. 1*b* illustrates the zipper securing device in use. The elastic loop assembly 2 is stretched over and around the post. The post is fixedly attached to the suitcase 9. A button could also be used in place of the post.

The elastic loop assembly 2 stretches over the post 3 to keep the zipper secured in the closed position. In the case where a typical dual slide zipper assembly is employed on the suitcase, each zipper pull incorporates an elastic loop assembly, and a post is placed on both ends of the zipper so that the user may close the case by pulling the dual slide to either end of the zipper. Thus, each slide is fitted with an elastic loop assembly and the posts have an annular groove sized to accommodate both loops.

Figure 2A:
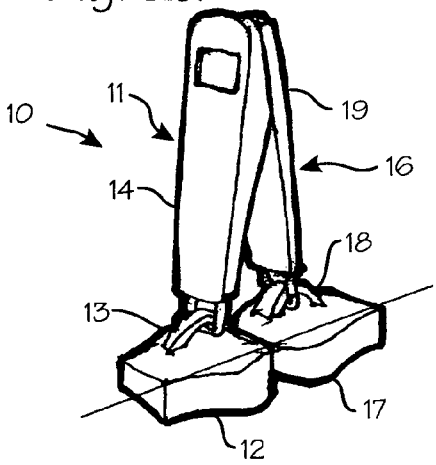
FIGS. 2*a* through 2*c* show a zipper securing device for use with two zipper pulls on a double zipper type assembly.
Figure 2B:
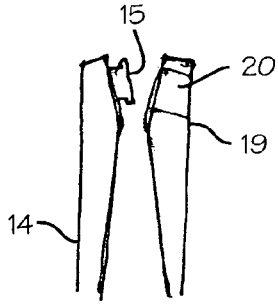
Figure 2C:
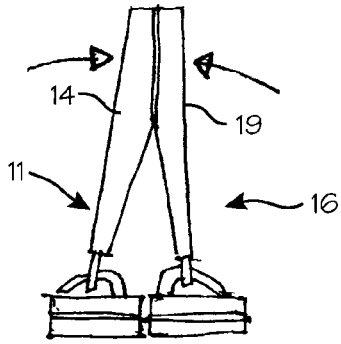

FIGS. 2*a* through 2*c* show a zipper securing device 10 comprised of two zipper pull assemblies which are releasably attached to each other to keep the zipper secured in the closed position. A male zipper slider assembly 11 comprises a first zipper slider 12 and first upstanding loop 13 attached to a male zipper pull 14. The male zipper pull incorporates a male member, such as a molded post 15, attached to the back side of the pull such that it will come into contact with the female zipper slider assembly. A female zipper slider assembly 16 comprises a second zipper slider 17 and second upstanding loop 18 attached to a female zipper pull 19. The female zipper pull incorporates an eyelet 20 machined to receive the molded post of the male zipper slider assembly. The male and female zipper pulls fit together, snapping into place and thus keep the zipper secured in the closed position.

FIG. 3*a* shows a zipper securing device 21 comprised of a hook assembly 22 and zipper pull assembly 23. The hook assembly comprises elastic cording 24 fished through a hook 25. The distal ends of the elastic cording are slipped through an opening in a seam of the suitcase and secured to a base (not shown) or otherwise tied together such that the ends will not come apart when force is applied to the hook assembly. The hook assembly hides under a pocket in the suitcase fabric and pulls out in operation. The zipper pull assembly 23 comprises a zipper slider 27, upstanding tang or loop 28, and zipper pull 29. The zipper pull has an opening or slot 30 at its distal end into which the hook assembly hooks. FIG. 3*b* illustrates the zipper securing device in use. The hook assembly 22 is pulled out from a pocket in the suitcase fabric and pulled under and hooked into the slot at the distal end of the zipper pull assembly 23. The hook of the hook assembly stretches into the slot to keep the zipper secured in the closed position. In the case of a dual zipper assembly employed on the suitcase, only one of the zipper sliders needs the zipper pull assembly. The zipper pull furthest from the hook assembly is provided with the opening, and the pull is disposed when secured, over the second slider 27*b*.

FIG. 4 shows a zipper securing device 31 comprised of an elastic loop assembly 32 and zipper slider assembly 33. The elastic loop assembly comprises elastic cording 34 wherein the distal ends of the elastic cording are fixedly attached to a base 35. The base is riveted or fixedly attached to the suitcase fabric. A flexible plastic sleeve 36 encompasses the elastic cording at the end of the elastic loop assembly that comes into contact with the zipper slider assembly 33. The zipper slider assembly 33 comprises a zipper slider 37 and upstanding tang or loop 38. The loop is formed into a cleat 39, with the cleat providing a catch opposite the base. In use, the elastic loop assembly 32 stretches over and around the cleat 39 of the zipper slider assembly 33 to keep the zipper secured in the closed position. In the case of a dual zipper assembly employed on the suitcase, only one of the zipper sliders has the cleat, the zipper slider furthest from the elastic loop assembly.

Thus, while the preferred embodiments of the devices and methods have been described in reference to the environment in which they were developed, they are merely illustrative of the principles of the inventions. Other embodiments and configurations may be devised without departing from the spirit of the inventions and the scope of the appended claims.

We claim:

1. A zipper securing device for releasably securing a zipper in the closed position on a zippered article, said zipper comprising a slider and loop, said zipper securing device comprising:

an elastic loop assembly comprising elastic cording fixedly attached to a base, the base fixedly attached to the zippered article; and a zipper slider assembly comprising a zipper slider, a cleat and a closed loop wherein the cleat protrudes from a top portion of the closed loop, and wherein the elastic loop assembly is stretched over and around the cleat when the zipper is in the closed position.

2. A zipper securing device of claim 1 wherein the elastic loop assembly further comprises a flexible plastic sleeve completely encompassing a portion of the elastic cording furthest away from the base.

3. A zipper securing device of claim 2 wherein the flexible plastic sleeve protects the elastic cording from outside forces.

4. A zipper securing device for releasably securing a zipper in the closed position on a zippered article, said zipper comprising a slider and loop, said zipper securing device comprising:

a hook assembly comprising a hook and elastic cording attached to the hook, the hook assembly fixedly attached to the zippered article; and a zipper pull assembly comprising a zipper slider, a loop and a zipper pull, the zipper pull having a slot at its distal end, wherein the elastic cording stretches and the hook hooks into the slot of the zipper pull assembly when the zipper is in the closed position.

5. A zipper securing device for releasably securing a zipper in the closed position on a zippered article, said zipper comprising a slider and loop, said zipper securing device comprising:

an elastic loop assembly comprising elastic cording fixedly attached to only one base, the base connected to the zipper slider loop; and a post having an annular groove and fixedly attached to the zippered article, wherein the elastic cording is stretched over and around the post and into the annular groove when the zipper is in the closed position.

6. A zipper securing device of claim 5 wherein the post has two annular grooves.

7. A zipper securing device of claim 5 wherein the elastic loop assembly further comprises a flexible plastic sleeve completely encompassing a portion of the elastic cording furthest away from the base.

8. A zipper securing device of claim 7 wherein the flexible plastic sleeve protects the elastic cording from outside forces.

* * * * *